United States Patent [19]

Ramirez et al.

[11] Patent Number: 4,508,490

[45] Date of Patent: Apr. 2, 1985

[54] TWO STAGE MANUAL AIR PUMP

[75] Inventors: Joe D. Ramirez; Steven E. Gorin, both of Panama City; William A. Garnett, Panama City Beach, all of Fla.

[73] Assignee: The United States of America as represented by the Secretary of the Navy, Washington, D.C.

[21] Appl. No.: 569,646

[22] Filed: Jan. 10, 1984

[51] Int. Cl.[3] ..... F04B 21/04; F04B 25/02

[52] U.S. Cl. ..... 417/234; 417/238; 417/265

[58] Field of Search ..... 417/265, 254, 258, 259, 417/244, 214, 238, 62, 469, 488, 234; 92/65; 60/576, 577; 188/300; 267/64.12

[56] References Cited

U.S. PATENT DOCUMENTS 1,149,324 8/1915 Baldwin ..... 417/265

1,424,928 8/1922 McClelland ..... 417/258

2,175,947 10/1939 Teeple ..... 417/469

2,185,264 1/1940 Mistral ..... 417/214

FOREIGN PATENT DOCUMENTS 2307986 12/1976 France ..... 417/234

*Primary Examiner*—Richard E. Gluck

*Assistant Examiner*—Peter M. Cuomo

*Attorney, Agent, or Firm*—Robert F. Beers; Harvey A. David

[57] ABSTRACT

A hand pump that is operable selectively as a large volume low pressure air pump or a smaller volume higher pressure pump has a small diameter cylinder reciprocable in a large diameter cylinder and carrying a large diameter plunger and a small diameter plunger reciprocable in the small diameter cylinder. Wire bail type latches are operable to select the mode of pump operation upon reciprocation of the pump handle.

1 Claim, 2 Drawing Figures

TWO STAGE MANUAL AIR PUMP

BACKGROUND OF THE INVENTION

This invention relates to hand-operated air pumps, and more particularly to a two-stage pump having notable utility in the inflation of larger items such as inflatable boats.

Heretofore, two and sometimes three separate hand-operated pumps have been required to rapidly and properly inflate a rubber boat. A first, large diameter, high volume pump was used to inflate the boat to about 3 psi. Then a smaller diameter pump was used to raise the pressure to about 7 psi. The extra pump has taken up valuable storage space and has required additional time to change pump connections.

SUMMARY OF THE INVENTION

With the foregoing in mind, it is a principal object of the invention to provide a compact, reliable, and easily operated hand pump for rapidly inflating large items, such as inflatable boats, to a full and properly pressurized condition.

Another object of the invention is to provide a novel and useful plural stage hand operated air pump capable of delivering large volume of air per stroke at very low pressures, and a lesser volume of air per stroke at higher pressures.

Yet another object is to provide a plural stage pump device having telescoping, cooperative, and selectively usable cylinders of different diameters for effecting pumping at different pressures.

Other subjects and many of the attendant advantages will be readily appreciated as the subject invention becomes better understood by reference to the following detailed description, when considered in conjunction with the accompanying drawings.

DESCRIPTION OF THE PREFERRED EMBODIMENT

Figure 1:
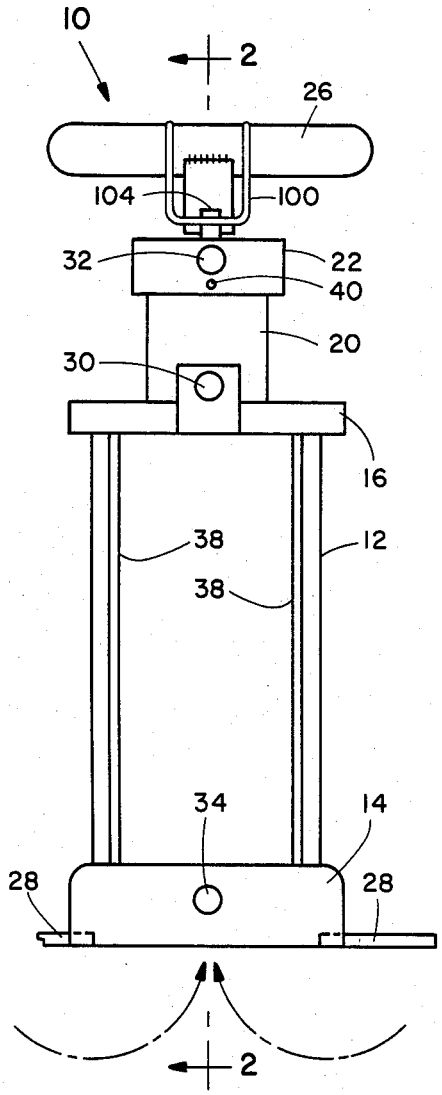
FIG. 1 is a front elevational view of a selective two-stage pump embodying the invention.

In the exemplary form of the invention illustrated in the drawings, a selective volume, two-stage air pump, generally indicated at 10, comprises a large diameter or low pressure cylinder or pump barrel 12 mounted on a base 14 and having an upper end cap 16. The pump 10 further comprises a high pressure cylinder or barrel 20 extending through the cap 16 for reciprocation within the barrel 12. The upper end of the barrel 20 is provided with an end cap 22 through which extends a plunger shaft 24 having a T-shaped handle 26 at its upper end. The base 14 is provided with foot plates swingable between laterally extended operative positions and stored positions within the base 14.

The end caps 16 and 22 are provided with threaded inlet ports 30 and 32, respectively, while the base 14 is provided with a threaded outlet port 34.

Figure 2:
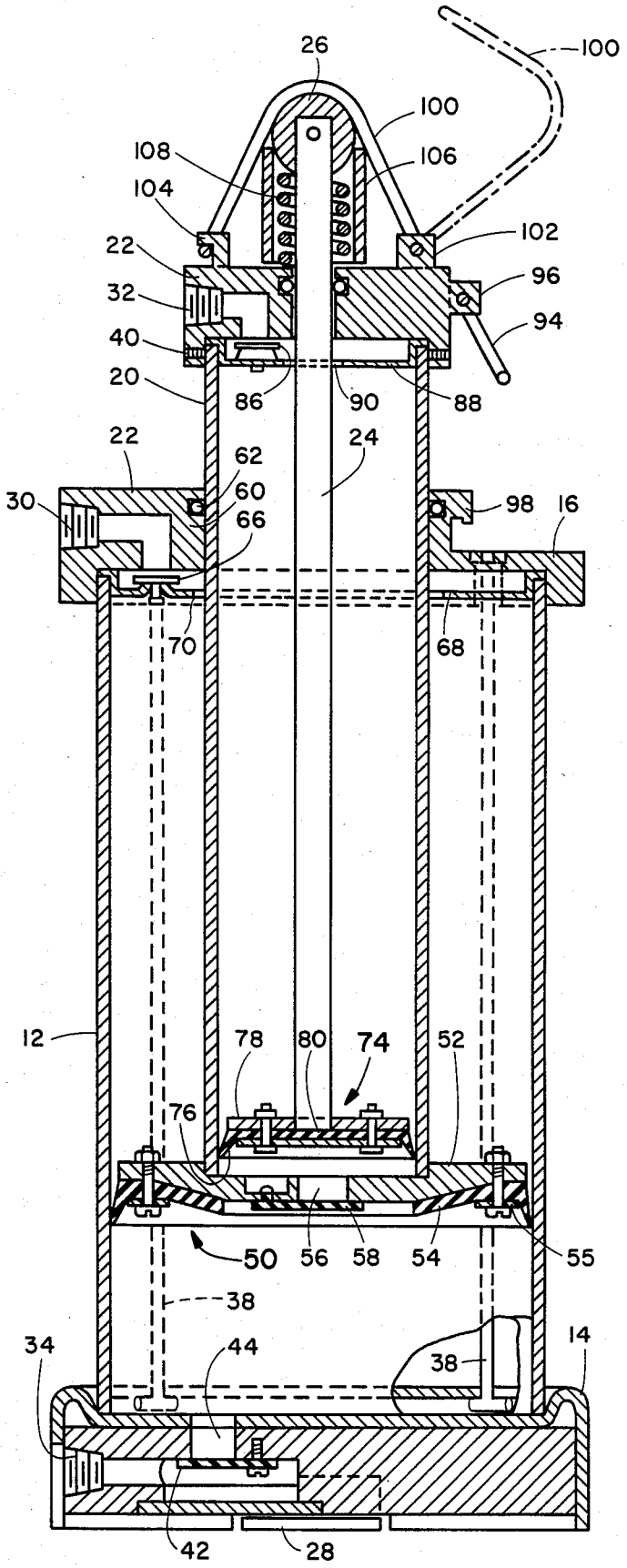
FIG. 2 is a vertical sectional view, on an enlarged scale, taken substantially along line 2—2 of FIG. 1.

With more particular reference to FIG. 2, the base 14 and cap 16 are retained on the larger diameter barrel 12 by rods 38, while the end cap 22 is retained on the smaller barrel by set screws 40. The base 14 further comprises a check valve 42 disposed in an outlet passage leading from the interior of barrel 12 to outlet port 34.

The lower end of barrel 20 is provided with a plunger, generally indicated at 50 and comprising a circular backing plate 52 and a flexible plunger cup 54 of rubber or the like secured between the backing plate and a metal ring 55. A passage 56 in the backing plate 52 communicates between the interior of the smaller barrel 20 and the interior of the larger barrel beneath the plunger 50. A check valve 58 limits flow in passage 56 to one direction.

The upper end cap 16 has a central bore 60 in which the smaller barrel 20 reciprocates, an O-ring seal 62 being seated in the end cap around that barrel. A passage 64 is defined in the end cap 16 communicating between the interior of barrel 12 and inlet port 30. Passage 64 is controlled by a check valve 66 carried by a valve plate 68. The valve 66 is illustrated in its open position relative to passage 64, allowing air to enter through port 30, passage 64, and opening 70 in plate 68 into the barrel 12 during downward movement of plunger 50. Valve 66 closes passage 64 during upward movement of plunger 50.

A plunger, generally indicated at 74, is fixed on the lower end of shaft 24 and comprises a rubber plunger cup 76 secured between a circular backing plate 78 and a metal disc 80. The upper end cap 22 has a central bore 80 in which the shaft 24 reciprocates, an O-ring seal being seated in the end cap around that shaft. A passage 84 is defined in the end cap 22 communicating between the interior of barrel 20 and inlet port 32. Passage 84 is controlled by a check valve 86 carried by a valve plate 88. The valve 86 is illustrated in its open position relative to passage 84, allowing air to enter through port 32, passage 84, and opening 90 in plate 88 into the barrel 20 as during downward movement of plunger 74.

In accordance with the invention, the pump 10 is operated either as a large volume, low pressure pump or as a smaller volume, higher pressure pump. To this end, the end cap 22 of the smaller barrel 20 is provided with a pivotable wire bail or latch element 94, conveniently journalled in an eye member 96 extending from that cap. The latch element 94 is adapted to releasably engage a hook 98 projecting from the end cap 16 of the larger barrel 12. The latch element 94 is shown in its unlatched position wherein the barrel 20 and plunger 50 are free to reciprocate within the larger barrel 12. Additionally, the end cap 22 is provided with a second wire bail or handle latch element 100, one end of which is pivoted in an eye member 102 wxtending from cap 22, and the other end of which is releasably engageable with a hook member 104 extending from the cap 22 at a location diametrically opposed to eye member 102. The latch element 100 is shown in its handle latching position wherein handle 26 is locked in a down position that prevents reciprocation of plunger 74 within barrel 20.

The pump handle is provided with a tubular stop member 106, within which is conveniently received a cushioning spring 108.

In operation a suitable hose is connected between outlet port 34 and an article to be inflated. The pump handle 26 is worked up and down with the latch 94 disengaged and latch 100 engaged, whereby the plunger 50 is operative while the plunger 74 is inoperative and the pump is effective as a large volume low pressure device for fast inflation. When the article is inflated to the point that operation of the pump becomes difficult due to pressure in the article, the latch 94 is engaged and the latch 100 released. Thereafter, the plunger 74 is operative and plunger 50 is inoperative so that working of the handle up and down results in operation of the pump as a lower volume, relatively high pressure pump to complete inflation of the article to the desired pressure.

Obviously, other embodiments and modifications of the subject invention will readily come to the mind of one skilled in the art having the benefit of the teachings presented in the foregoing description and the drawing. It is, therefore, to be understood that this invention is not to be limited thereto and that said modifications and embodiments are intended to be included within the scope of the appended claims.

What is claimed is:

1. A selective volume hand pump operable alternatively as a low pressure pump and as a high pressure pump, said pump comprising:

a large diameter pump cylinder having a large diameter end cap;

a small diameter cylinder having a small diameter end cap, said small diameter cylinder being reciprocable in said large diameter cylinder and carrying a large diameter plunger;

a small diameter plunger reciprocable in said small diameter cylinder; and a handle and shaft attached to said small diameter plunger, said shaft extending through said small diameter end cap; and operation selecting means for causing said small diameter cylinder and large diameter plunger to reciprocate with said handle relative to said large diameter cylinder during operation as a low pressure pump and for securing said small diameter cylinder and large diameter plunger against reciprocation in said large diameter cylinder during operation of said pump as a high pressure pump, said operation selecting means comprising first latch means operable between said small diameter cylinder and said handle for releasably connecting said handle and said small diameter cylinder together, second latch means operable between said small diameter cylinder and said large diameter cylinder for releasably connecting thereof together, said first and second latch means comprising first and second wire bail elements, respectively, said first latch means comprising a first wire bail element pivoted on said small diameter end cap for swinging movement over said handle into and out of a handle securing position, a first hook member projecting from said small diameter end cap and engagable by said first wire wire bail element when in said handle securing position, said second latch means comprising a second wire bail element pivoted on said small diameter end cap and a second hook member projecting from said large diameter end cap and engagable by said second wire bail element.

* * * * *